US006440910B1

(12) United States Patent
Smith et al.

(10) Patent No.: US 6,440,910 B1
(45) Date of Patent: Aug. 27, 2002

(54) HYDROPHOBIC AND PARTICULATE SOIL REMOVAL COMPOSITION AND METHOD FOR REMOVAL OF HYDROPHOBIC AND PARTICULATE SOIL

(75) Inventors: Kim R. Smith, Woodbury; Robert D. P. Hei, Baldwin; Carrie Armstrong, Mahtomedi; Paul Mattia, Prior Lake; Wendy Wiseth, St. Paul; Jennifer Layton, White Bear Lake; Mark Levitt, St. Paul, all of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/715,692

(22) Filed: Nov. 17, 2000

Related U.S. Application Data

(62) Division of application No. 09/275,851, filed on Mar. 24, 1999, now Pat. No. 6,180,592.

(51) Int. Cl.[7] ..... C11D 3/20; C11D 1/825

(52) U.S. Cl. ..... 510/130; 510/505; 510/506

(58) Field of Search ..... 510/403, 413, 510/505, 130

(56) References Cited

U.S. PATENT DOCUMENTS

| | | | |
|---|---|---|---|
| 3,417,023 | A | 12/1968 | Di Salvo |
| 3,635,829 | A | 1/1972 | Yang |
| 3,664,962 | A | 5/1972 | Kelly et al. |
| 4,289,644 | A | 9/1981 | Steinhauer et al. |
| 4,363,756 | A | 12/1982 | Sepulveda et al. |
| 4,396,521 | A | 8/1983 | Borrello |
| 4,595,520 | A | 6/1986 | Heile et al. |
| 4,680,134 | A | 7/1987 | Heile et al. |
| RE32,818 | E | 1/1989 | Fernholz et al. |
| 4,836,949 | A | 6/1989 | Klajnscek |
| 4,842,762 | A | 6/1989 | Sabol, Jr. et al. |
| 4,877,556 | A | 10/1989 | Wilsberg et al. |
| 4,909,962 | A | 3/1990 | Clark |
| 5,523,000 | A | 6/1996 | Falbaum et al. |
| 5,538,662 | A | 7/1996 | Klier et al |
| 5,660,641 | A | 8/1997 | Howe |
| 5,672,340 | A | 9/1997 | Sun et al. |
| 5,741,768 | A | 4/1998 | Falbaum et al. |
| 5,750,484 | A | 5/1998 | Falbaum et al. |

OTHER PUBLICATIONS

Allen's Commercial Organic Analysis, vol. III, pp. 13–21; 37; and 56–59.

*Primary Examiner*—John Hardee
(74) *Attorney, Agent, or Firm*—Merchant & Gould P.C.

(57) ABSTRACT

A hydrophobic and particulate soil removal composition is provided. The composition can be used for removing organic hydrophobic soils, such as oily or greasy soils, from a laundry item and/or from a hard surface such as an engine part and/or from skin. The composition can be used in a liquid or solid form and can be applied to individual laundry items in the form of a solid stick or liquid spray prior to introduction to the laundry machine. Laundry items can also be contacted in the laundry machine with the pre-spot or pre-treatment composition in the form of an aqueous presoak, preflush, prewash, or other step prior to the cleaning step. The treatment composition can be used as a recirculating liquid stream or bath for the cleaning of hard surfaces. The composition includes an ethoxylate component and a fatty acid ester component.

45 Claims, No Drawings

HYDROPHOBIC AND PARTICULATE SOIL REMOVAL COMPOSITION AND METHOD FOR REMOVAL OF HYDROPHOBIC AND PARTICULATE SOIL

Div of application Ser. No. 09/275,851 Mar. 24, 1999, now U.S. Pat. No. 6,180,592.

FIELD OF THE INVENTION

The invention relates to a hydrophobic and particulate soil removal composition and method for removal of hydrophobic and particulate soil from an article. Stubborn hydrophobic greasy or oily soils, including associated organic particulate soils, such as finely divided elemental carbon, are frequently encountered on fabrics including textiles and on hard surfaces including engine parts. The composition is selected to provide enhanced soil renoval, preferably in institutional laundry applications and in industrial parts cleaning applications.

BACKGROUND OF THE INVENTION

Detergent pre-treatment or pre-spotting compositions, solids or sticks are known in the art and are known to commonly use solvent materials and typically nonionic surfactants. For example, see DiSalvo, U.S. Pat. No. 3,417,023; Kelly, et al., U.S. Pat. No. 3,664,962; Steinhauer et. al., U.S. Pat. No. 4,289,644; and Sabol, Jr. et al., U.S. Pat. No. 4,842,762. These patents describe pretreatment or pre-spotting compositions containing a small amount of water and a substantial proportion of solvent, nonionic surfactant and a solidification or gelling agent. Wilsberg, et al., U.S. Pat. No. 4,877,556, and Clark, U.S. Pat. No. 4,909,962 describe compositions which include hydrocarbon solvent. Borrello, U.S. Pat. No. 4,396,521 teaches liquid aqueous pre-spot or pre-treatment compositions containing about 35 wt % water and substantial water soluble solvent compositions to create a use solution. Such aqueous and solvent based materials are typically less effective on oily hydrophobic soils due to the nature of the soil and its hydrophobicity with respect to the aqueous formulated materials. A solvent based laundry pre-treatment stick is disclosed in Steinhauer et al., U.S. Pat. No. 4,289,644, and includes a minor amount of water but relatively large percent of immiscible solvent in separate but combined phases. Klier et al., U.S. Pat. No. 5,538,662 and Yang, U.S. Pat. No. 3,635,829, describe pre-spot or pre-treatment compositions. One liquid detergent composition having a specialized phosphate ester solubilizer is disclosed in Klajnscek, U.S. Pat. No. 4,836,949. The patent discloses preferred formulations for use in a liquid stabilized laundry detergent.

While these prior art pre-spot or pre-treatment compositions have some utility in pre-spotting common household laundry, commercial laundry having large quantities of hydrophobic soils, particularly oily or greasy soils containing substantial quantities of particulate matter, can resist conventional pre-spotting pre-treatments and also resist the effects of conventional laundry detergents even in industrial or commercial laundry machines such as commercial 450 pound wash wheels or tunnel washers. A substantial need exists for improved pre-spotting or pre-treating laundry compositions.

The invention relates to a parts cleaning composition and can promote the removal of hydrophobic and particulate soil from parts or hard surfaces, particularly those parts encountered in the engine cleaning industry. Parts cleaning compositions commonly used include hydrocarbon solvent.

These types of compositions generally provide a high level of volatile organic compounds, are flammable and corrosive, and are tough on a worker's hands.

BRIEF DISCUSSION OF THE INVENTION

A hydrophobic and particulate soil removal composition is provided by the invention. The hydrophobic and particulate soil removal composition includes an effective soil treating amount of an ethoxylate component and an effective soil treating amount of a fatty acid ester component. The ethoxylate component has the formula:

$$R_1—(OC_2H_4)_m—OH$$

wherein $R_1$ contains about 6 to about 26 carbon atoms and m is about 2 or less. Preferably, $R_1$ is an alkyl group containing from about 10 to about 16 carbon atoms or an aralkyl group containing from about 14 to about 20 carbon atoms, and m is between about 1 and about 2. The ethoxylate component is preferably an alcohol ethoxylate or an alkyl phenol ethoxylate. The fatty acid ester component has the formula:

$$R_3—CO_2—R_4$$

wherein $R_3$ is an alkyl group having about 6 to about 24 carbon atoms and $R_4$ is an alkyl group having about 1 to about 6 carbon atoms. Preferably, $R_3$ is an alkyl group containing from about 14 to about 20 carbon atoms, and $R_4$ is an alkyl group containing from about 1 to about 3 carbon atoms. The soil removal composition is preferably substantially free of hydrocarbon solvent.

The weight ratio of ethoxylate component to fatty acid ester component is preferably between about 1:4 and about 4:1, and more preferably between about 3:1 and about 1:3. It should be appreciated that the ethoxylate component can include mixtures of different ethoxylates, and the fatty acid ester component can include mixtures of different fatty acid esters. In addition, the soil removal composition can include a processing aid for providing freeze stability, and other components which are conventional in the detergent industry. The concentration of ethoxylate component and fatty acid ester component in the soil removal composition depends on the desired use of the composition. When applied as a pre-treatment or pre-spotting composition, the composition can be relatively concentrated and may be provided in the form of a solid or stick. In addition, the composition can be provided as a fluid which will flow through a dispenser. When used as a hard surface cleaning composition, the use concentration of ethoxylate component and fatty acid ester component is preferably relatively dilute. Of course, the composition can be provided as a concentrate, and then diluted to provide the use concentration. When used to wash skin, such as hands, the composition can be provided in the form of a solid bar, a viscous gel, or a flowable fluid which can be dispensed through a liquid dispenser. The soil removal composition can then be rubbed on the skin and wiped away or washed off.

A method for removing hydrophobic and particulate soil from an article is provided by the invention. The method includes the step of contacting a soiled article with a hydrophobic and particulate soil removal composition. The hydrophobic and particulate soil removal composition is allowed to penetrate into the soil in order to break apart the soil. The soil removal composition of the invention is particularly suited for breaking apart caked soil. Caked soil can generally be characterized as having an average thickness of between about 0.1 mm and about 10 mm. The soil can be removed from textiles, including natural and synthetic fiber-containing textiles, hard surfaces such as those encountered in the automotive industry, and skin. In the case of using the soil removal composition of the invention to remove soil from textiles, the composition is preferably used as a pre-treatment composition which is then followed by a wash treatment with a detergent composition such as a conventional detergent composition. Preferably, the textiles are treated with the pre-treatment composition for a length of time sufficient to break up the soil. The pre-treatment composition is then preferably allowed to drain from the textiles prior to treatment of the textiles with a detergent composition. When the soil removal composition of the invention is used to remove soil from hard surfaces, it is preferably used as a relatively dilute fluid such as a recirculation fluid. That is, it can be diluted with water and then recirculated over a hard surface to remove the soil from the hard surface. In the case of treating skin, the soil removal composition can be rubbed onto the skin and washed off with water or wiped off.

DETAILED DESCRIPTION OF THE INVENTION

The invention relates to a hydrophobic and particulate soil removal composition, and to a method for removing hydrophobic and particulate soil from an article. It should be understood that hydrophobic and particulate soils refer to oily or greasy soils containing particulate matter. In general, this type of soil can often be characterized by a caked appearance. Exemplary hydrophobic soils include hydrocarbons, tars, bitumens, asphalts, etc. Exemplary particulates which can be found in the hydrophobic soil include mineral clays, sand, dirt, clays, natural mineral matter, carbon black, graphite, graphitic materials, caolin, environmental dust, etc. In general, soils which are of particular concern include clean and dirty motor oils, asphaltenes, hydrocarbon, and coal tars, petroleum greases, fatty body soils, transmission fluids, hydraulic oils and greases, and the like. These soils are typical of the soils often found in truck or auto repair shops, gasoline and/or filling stations, industrial maintenance shops, petroleum refining and processing plants, machine repair shops, and food preparation facilities, and are fairly resistant to removal by washing with conventional detergents. Exemplary articles which can be subjected to cleaning for the removal of these soils include worker's clothing, machine parts, grill parts, and oil pans. The soil found on these articles is often characterized by a caked on appearance. In addition, animal skin, such as human skin, is often contaminated with these soils, and is difficult to clean with convention detergents.

The hydrophobic and particulate soil removal composition can be referred to more simply as the soil removal composition. It should be appreciated that there is no requirement that the soil which is to be removed contain a certain level of particulate matter. Rather, the soil can contain essentially no particulate matter. It is expected that the hydrophobic soil encountered in the environments identified above will typically contain particulates. In addition, it is understood that the particulate matter is generally considered at least partly responsible for providing "caked soil" for which the composition of the invention is particularly suited for removing or breaking apart. Caked soil can generally be characterized as having a thickness of between about 0.1 mm and about 10 mm. In general, caked soil will exhibit an average thickness of greater than about 0.25 mm. Most common caked soils have an average thickness of about 1 mm. In addition, caked soils generally exhibit a viscosity of greater than about 1,000 cps.

The soil removal composition includes an effective soil treating amount of ethoxylate component, and an effective soil treating amount of fatty acid ester component. Applicants found that the combination of the ethoxylate component and the fatty acid ester component provides enhanced hydrophobic and particulate soil removal properties compared with use of either ethoxylate component or fatty acid ester component, individually. In addition, the soil removal composition preferably includes a processing aid to provide the composition with freeze stability.

The ethoxylate component includes an ethoxylate or a mixture of ethoxylates. The ethoxylate component is preferably a nonionic ethoxylate. Preferred ethoxylates which can be used according to the present invention preferably have the formula:

$$R_1—(OC_2H_4)_m—OH$$

wherein $R_1$ contains from about 6 to about 26 carbon atoms, and m is about 2 or less. $R_1$ can be a group which is considered branched or unbranched, saturated or unsaturated, substituted or unsubstituted, aliphatic or aromatic or aliphatic and aromatic. $R_1$ is preferably an alkyl group containing from about 10 to about 16 carbon atoms or an aralkyl group containing from about 14 to about 20 carbon atoms, and m is preferably from about 1 to about 2. It should be appreciated m reflects an average value, and a particularly preferred alcohol ethoxylate has an m value of about 1.3. Preferred ethoxylates include alkyl phenol ethoxylates and alcohol ethoxylates. The alkyl phenol ethoxylate preferably has the formula:

$$Ar—(OC_2H_4)_M—OH;$$

wherein Ar is:

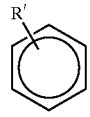

wherein R' is a straight or branched alkyl group of about 1 to 9 carbon atoms. The Ar group can include two or more R' groups. The alcohol ethoxylate which can be used in the present invention has the formula:

$$R_2—(OC_2H_4)_m—OH$$

wherein $R_2$ is a straight or branched fatty alkyl group containing from about 6 to 24 carbon atoms, preferably about 10 to 18 carbon atoms and most preferably about 12 to 18 carbon atoms, m is an integer of less than about 2.

The fatty acid ester component includes a fatty acid ester or a mixture of fatty acid esters which, when combined with the ethoxylate, provides penetration into hydrophobic and particulate soil. A preferred fatty acid ester can be represented by the following formula:

$$R_3—CO_2—R_4$$

wherein $R_3$ is a linear or branched alkyl group containing from about 6 to about 24 carbon atoms, and $R_4$ is an alkyl group containing from about 1 to about 6 carbon atoms. Preferably, $R_3$is an alkyl group containing from about 14 to about 20 carbon atoms, and $R_4$ is an alkyl group containing from about 1 to about 3 carbon atoms. Examples of preferred fatty acid esters include fatty acid esters of soy, castor, oleic, linoleic, linolenic, ricinoleic, stearic, oaprylic, coconut, myristic, and wood acid abietic. Specific examples include methyl soyate, ethyl soyate, propyl soyate, methyl abietate, and propyl linoleate. Examples of mixtures of fatty acid esters include esters of soy, castor, and coconut. In general, the fatty acid ester of soy includes an ester composition prepared from about 26% by weight oleic, about 49% by weight linoleic, about 11% by weight linolenic, about 14% by weight saturated analogs, and the remainder phospholipids and sterols.

The soil removal composition preferably includes the ethoxylate component and the fatty acid ester component in amounts sufficient to provide desired soil modification performance. In general, the ratio of ethoxylate component to fatty acid ester component is provided between a range of about 1:4 and about 4:1, and more preferably between a range of about 1:3 to about 3:1. A particularly preferred ratio of ethoxylate component to fatty acid ester component is about 1:1.

The soil removal composition preferably includes a processing aid to provide freeze stability. It should be appreciated that the soil removal composition of the invention does not require a processing aid. That is, the soil removal composition of the invention can be provided without a processing aid. Processing aids which can be used according to the invention include glycol ethers and lower molecular weight glycols, such as, those including between about 2 and about 10 carbon atoms. Particularly preferred processing aids include alkyl glycol ethers such as 2-butoxy ethanol which is available under the name butyl cellosolve from Union Carbide. Additional processing aids include aryl glycol ethers, alkylated propylene glycols such as tripropylene glycol monomethyl ether, dipropylene glycol monomethyl ether, and monopropylene glycol monomethyl ether. Additional processing aids include polyglycol ethers such as those available under the name carbitol, including ethyl carbitol, propyl carbitol, and phenyl carbitol. In general, it is preferred not to include $C_{1-5}$ alcohols as processing oils because of their flammable nature.

The amount of processing aid incorporated into the soil removal composition of the invention can vary over a wide range. It should be understood that the soil removal composition can be provided free of any processing aid. In addition, if it is desirable to provide a very dilute soil removal composition, the processing aid can be incorporated in an amount up to about 99 wt.-%. When it is desirable to use a processing aid, it is expected that it will be included in an amount of between about 10 wt.-% to about 30 wt.-%. It should be appreciated that the amount of processing aid can very depending upon the use of the soil removal composition. In the case where the soil removal composition is used as a fluid which is capable of flowing through a liquid dispenser, it may be desirable to provide a relatively large amount of processing aid. In contrast, when the soil removal composition is provided in the form of a block or bar, very little processing aid, if any, may be used.

The soil removal composition of the invention preferably does not include any additional surfactant components. While additional surfactant components can be added, Examples 2 and 3 demonstrate that certain surfactants tend to decrease the effectiveness of the composition for removing caked on soil. Preferably, the soil removal composition does not include ethoxylates having 5 or more ethoxy groups per molecule. Even more preferably, the composition does not include ethoxylates having 3 or more ethoxy groups, and, in particular, greater than 2 ethoxy groups per molecule. In addition, the soil removal composition of the invention is preferably free of solvent liquid. By "solvent liquid," we mean solvents which are generally responsible for providing a composition with a high VOC content. Such solvents are typically referred to as organic solvents such as hydrocarbon solvents. As shown in Example 4, the soil removal composition of the invention (with the absence of high VOC mineral spirits) is at least as effective as a prior art industrial parts cleaning composition containing high VOC mineral spirits. Preferably, the soil removal composition does not include volatile hydrocarbons ($C_{1-4}$ hydrocarbons) and non-volatile hydrocarbons ($C_{5-40}$ hydrocarbons). In addition, the soil removal composition can be prepared so that it contains substantially no anionic surfactant.

The soil removal composition of the invention can be provided in the form of a liquid or a solid. When provided in a liquid form, the composition can be provided with a sufficiently low viscosity which allows it to flow through a conventional dispenser such as the T-Jet dispenser which is available from Ecolab, Inc. Furthermore, the soil removal composition can be provided as a relatively dilute composition or as a highly concentrated composition. The composition can be provided as a relatively viscous fluid in situations where viscous fluids are desirable including, for example, the treatment of vertical surfaces, and can be provided in a solid form such as a brick or stick for rubbing onto a soil. The composition can be used as a pre-treatment or pre-spot composition by application of the composition to an article prior to the conventional washing of the article. It is expected that this type of pre-treatment will be particularly advantageous for textiles. That is, the soil on a textile can be pre-treated with the soil removal composition of the invention. After pre-treatment, the textile can be washed using conventional detergents. In the case of hard surfaces or parts washing, it is expected that the soil removal of the composition will act as the detergent for removing the soil from the part or hard surface. In addition, when washing hands, it is expected that the soil removal composition will be used as the sole detergent composition for removing the soil.

The compositions of the invention can be prepared in aqueous solution using about 0.01 to 5 wt.-% of a substantially soluble organic or inorganic thickener material in the liquid composition. Inorganic thickeners typically comprise clays, silicates and other well known inorganic thickeners. Organic thickeners include thixotropic and non-thixotropic thickeners. Preferred thickeners have some substantial proportion of water solubility to promote easy removability. Examples of useful soluble organic thickeners for the compositions of the invention comprise carboxylated vinyl polymers such as polyacrylic acids and sodium salts thereof, ethoxylated cellulose, polyacrylamide thickeners, xanthan thickeners, guargum, sodium alginate and algin by-products, hydroxy propyl cellulose, hydroxy ethyl cellulose and other similar aqueous thickeners that have some substantial proportion of water solubility. Preferred thickeners for use in the invention include xanthan thickeners under the name of Keltrol and Keizan. Such xanthan polymers are preferred due to their high water solubility and substantial thickening capacity.

A hardening agent, as used in the present method and compositions, is a compound or system of compounds, organic or inorganic, that significantly contributes to the uniform solidification of the composition. Preferably, the hardening agent is compatible with the active ingredients of the composition, and is capable of providing an effective amount of hardness or aqueous solubility to the processed composition. The hardening agent should also be capable of forming a homogeneous matrix with the ingredients when mixed and solidified to provide a uniform dissolution of the cleaning agent from the solid composition during use. The amount of hardening agent included in the cleaning composition will vary according to the type of cleaning composition being prepared, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. It is preferred that the amount of the hardening agent is effective to combine with the cleaning agent and other ingredients of the composition to form a homogeneous mixture under continuous mixing conditions and a temperature at or below the melting temperature of the hardening agent.

The hardening agent can form a matrix with the cleaning agent and other ingredients which will harden to a solid form under ambient temperatures of about 30–50° C., preferably about 35–45° C., after mixing ceases and the mixture is dispensed from the mixing system, within about 1 minute to about 3 hours, preferably about 2 minutes to about 2 hours, preferably about 5 minutes to about 1 hour. A minimal amount of heat from an external source may be applied to the mixture to facilitate processing of the mixture. It is preferred that the amount of the hardening agent included in the composition is effective to provide a hardness and desired rate of controlled solubility of the processed composition when placed in an aqueous medium to achieve a desired rate of dispensing the cleaning agent from the solidified composition during use. Preferably, the hardening agent is present in an amount of about 0.01–20 wt-%, preferably about 0.05–5 wt-%, preferably about 0.1–3 wt-%. Another preferred hardening agent is a polyethylene glycol (PEG) or propylene glycol compound for use in a cleaning composition comprising a nonionic surfactant cleaning agent, such as a nonyl phenol ethoxylate, a linear alkyl alcohol ethoxylate, an ethylene oxide/propylene oxide block copolymers such as the surfactants available commercially under the trademark PLURONIC® from BASF-Wyandotte. The solidification rate of cleaning compositions comprising a polyethylene glycol hardening agent made according to the invention will vary, at least in part, according to the amount and the molecular weight of the polyethylene glycol added to the composition.

Preferred polyethylene glycol compounds useful according to the invention include, for example, solid polyethylene glycols of the general formula $H(OCH_2—CH_2)_nOH$, where n is greater than 15, more preferably about 30–1700. Solid polyethylene glycols which are useful are marketed under the trademark Carbowax®, and are commercially available from Union Carbide. Preferably, the polyethylene glycol is a solid in the form of a free-flowing powder or flakes, having a molecular weight of about 3000–100,000, preferably about 3000–8000. Suitable polyethylene glycol compounds useful according to the invention include, for example, PEG 3000, PEG 4000, PEG 6000, PEG 8000 among others, with PEG 8000 being preferred.

The hardening agent may also be a hydratable substance such as an anhydrous sodium carbonate, anhydrous sodium sulfate, or combination thereof. Preferably, the hydratable hardening agent is used in an alkaline cleaning composition which includes ingredients such as a condensed phosphate hardness sequestering agent and an alkaline builder salt, wherein the amount of caustic builders is about 5–15 wt-%, as disclosed, for example, in U.S. Pat. Nos. 4,595,520 and 4,680,134 and Re. No. 32,818, the disclosures of which are incorporated by reference herein. A hydratable hardening agent, according to the invention, is capable of hydrating to bind free water present in a liquid detergent emulsion to the extent that the liquid emulsion becomes hardened or solidified to a homogenous solid. The amount of a hydratable substance included in a detergent composition processed according to the invention, will vary according to the percentage of water present in the liquid emulsion as well as the hydration capacity of the other ingredients. Preferably, the composition will comprise about 10–60 wt-% of a hydratable hardening agent, preferably about 20–40 wt-%.

Other hardening agents that may be used in a cleaning composition processed according to the invention include, for example, urea, also known as carbamide, starches that have been made water-soluble through an acid or alkaline treatment process, and various inorganics that impart solidifying properties to a heated liquid matrix upon cooling. Advantageously, a cleaning composition processed according to the invention may comprise an amount of hardening agent which is about 50–85% lower than that included in a corresponding composition comprising substantially the same ingredients but prepared by another method such as a "molten process" known in the art. For example, where polyethylene glycol-based cleaning compositions would typically comprise about 10–30 wt-% polyethylene glycol hardening agent when made according to another method practiced in the art, a corresponding cleaning composition made according to the present process will comprise a reduced amount of the hardening agent, or about 3–15 wt-% polyethylene glycol, preferably about 5–8 wt-%, preferably about 2–6 wt-%, preferably about 5–6 wt-%.

The compositions of the invention can contain water soluble detergency builder materials capable of enhancing pre-treatment, sequestering hardness cations from service water, providing alkaline buffering for wash solutions and other known builder functions. Suitable builders include sodium or potassium nitrilotriacetate, sodium or potassium tripolyphosphate, tetrasodium or tetrapotassium pyrophosphate, soluble citrate salts, N-alkyl taurates, alkyl isethionates, cationic polymeric acrylates or copolymers thereof, zeolites, sodium alumina silicates, and other materials. The detergents, the builders of the invention can be present in amounts of from about 5 to 25 wt % of the total composition, preferably about 5 to 15 wt %. The optimal levels of builder salt materials will vary depending on the builders chosen and the surfactant blend.

The compositions of the invention may also contain additional typically nonactive materials, with respect to cleaning properties, generally found in liquid pre-treatment or detergent compositions in conventional usages. These ingredients are selected to be compatible with the materials of the invention and include such materials as fabric softeners, optical brighteners, soil suspension agents, germicides, pH adjusting agents, viscosity modifiers, perfumes, dyes, inorganic carriers, solidifying agents and the like.

The compositions of the invention can be formulated in a liquid, a non-aqueous liquid, a thickened aqueous liquid, or a solid product form. In the liquid formulations, the penetration ingredients of the invention are blended with an aqueous diluent to form a concentrate solution which can then be diluted at a use locus to active levels. The thickened liquid product form can be manufactured in an aqueous diluent with a thickening agent. Similarly, the thickened liquid can be diluted with water to form a use solution which is then used in a laundry machine. Alternatively, the thickened liquid material can be directly contacted with the soiled garment or fabric to treat stains or soils prior to laundering. The solid compositions of the invention can be made by combining the active surfactant materials with a solid forming agent or hardening agent. The solid compositions of the invention can then be dispensed from a spray on dispenser as a concentrated use solution which can then be diluted with water prior to use or the concentrate can be directly contacted with the soiled item. The solid formulations of the invention can also be contacted directly with a soiled or spotted area on the fabric or garment. Typically, the solid materials of the invention can be prepared by blending the active surfactant ingredients with a solid forming agent under conditions that promote blending of the materials to a uniform composition. The blended composition is then placed into forms or extruded through an appropriately sized die to form the solid treatment compositions.

When the soil removal composition of the invention is used as a pre-treatment composition for the pre-treatment of textiles, it is preferable that the soil removal composition is rinsed away prior to introduction of a detergent composition for washing the textiles. The detergent composition which can be used for washing the textiles include any of a number of commercially available detergent compositions.

Following the pre-treatments step, conventional detergents can be used. Exemplary detergents are available under the names Tide® and Cheer® from The Proctor and Gamble Company, and under the names Turbo Rev® and Kindet® from Ecolab, Inc.

The compositions of the invention are typically used by metering into a commercial or tunnel washing machine, a useful amount of the formulated pre-spot or pre-treatment compositions in a prewash cycle or a prewash portion of a tunnel washer. The concentration of materials is typically at about 0.01 to 2 wt % in the aqueous solution in the washer used to pre-treat the garments or fabric. The garments or fabric are typically treated at ambient or elevated temperatures, typically about 20° C. to about 60° C., preferably about 22° C. to about 30° C. for a sufficient period of time to pre-treat spots and stains. Typically, depending on the concentration of the surfactant blend used, the pre-treatment can be contacted with the stains for about 10 to about 600 seconds, preferably about 20 to about 300 seconds. Typically, agitation of the composition of the clothing does not substantially improve treatment as long as the stains are saturated with the treatment solution. In order to promote saturation, the washer load can be agitated mechanically. Aernatively, the treatment compositions of the invention can be directly contacted with the soiled fabric or garment prior to introducing the soiled item into the washing machine. Typically, the material is sprayed or physically contacted with the soiled item. In the case of the use of a liquid material, common spray, nebulizer, or other equivalent that can apply the liquid material directly to the stain or spot can be used. In using the solid formulations of the invention, the solid block or stick can be directly contacted with the stain or spot leaving the solid formulation in the form of a thin film or residue substantially covering the entirety of any spot or stain on the garment. The pre-treated garment can be left to permit the surfactant compositions of the formulation to associate with the stain to pre-treat the stain or spot outside the washing machine. However, the pre-treated garment or fabric can be immediately introduced into a prewash or pre-treatment cycle or stage of the tunnel washer. The washing machine can, at this time, contain an aqueous diluent that can aid in pre-treating the soiled items or the items can be simply introduced into the washing machine without aqueous materials to simply permit the pre-treatment compositions to complete pre-treating the soil prior to a conventional laundry step. While the pre-spot and pre-treatment compositions of the invention can be used with any laundry composition, the formulations disclosed in Falbaum et al., U.S. Pat. Nos. 5,523,000; 5,741,768 and 5,750,484 are preferred. The pre-treatment composition is preferably allowed to drain prior to washing with a conventional laundry composition. In addition, the pre-treatment composition can be rinsed prior to washing with a conventional laundry composition.

Fabrics which can be treated with the soil removal composition of the invention include woven fabrics, non-woven fabrics, and knitted fabrics. The fabrics can include fibers such as cotton fibers, polyester fibers, polyamide fibers such as nylon, acrylic fibers, acetate fibers, and blends thereof including cotton and polyester blends. Exemplary hard surfaces which can be treated by the soil removal composition of the invention include those hard surfaces normally encountered in the automotive industry. Exemplary hard surfaces include metals, glass, plastics, rubbers, and ceramics.

The foregoing discussion of the invention provides a basis for understanding the ingredients and compositions of the invention. The following exemplary material and data provide a further her explanation of the application of the invention to laundry processes and disclose a best mode.

EXAMPLE 1

Soil penetration tests were performed using commercially purchased automotive oil pans containing heavy dirty motor oil/grease soilings (3–10 mm thick). The pans were cut into 2"×4" coupons and subjected to soil modification by measuring compositional droplet wick times into the soil layer (0.1 ml of the aqueous test solution per $cm^2$); with complete absorption-time being visually determined. The test solutions were prepared by mixing 0.5 wt % of each composition with 0.5 wt % sodium meta silicate/EDTA (builder) and the remainder water. Each was vigorously mixed into an emulsion phase and applied to the test surface. Measurements were made of the timed penetration rate into the solidified dirty motor oil layers. Soil variations were separately tested by using triplicate runs of the coupons.

Table 1 demonstrates the usefulness of the present invention as a hydrophobic/particulate soil penetrant and modifying agent for enhancing hard surface cleaning processes and as a soil modifier for subsequent chemical cleaning steps from textiles and hard surfaces. Attention is directed to the results presented in column 3 of Table 1 comparing soil modification penetration rates for compositions 1–10 where compositions 1–5 are prior art compositions. The data demonstrates the ability of the invention to impart a modification to the soil by penetrating the soil cake at an appreciably faster relative rate compared with the control (ILF-15 is a dirty motor oil pre-treatment product with >2-EO nonionic blends and mineral spirits), and substantially better than other prior art compositions. It is noticed in the experiments (examples 2–5) that nonionics with >2-EO nonionics have substantially reduced soil modification rates, relative to the control, while the compositions of the invention provide yields up to a 50% improvement in soil penetration over even the high performing commercial control detergent, i.e., the novel use of an ethoxylated nonionic with less than 2-ethoxylate units along with a fatty ester as a soil modifier. The ethoxylate is an alcohol ethoxylate wherein the alkyl group has between about 12 and about 14 carbon atoms and the degree of polymerization is about 1.

The lack of emulsification capacity (normally employed as evidencing detersive effectiveness) of the compositions of the invention compared with the prior art is shown in column 4 of Table 1. In contrast to the prior art, the compositions of the invention are very poor emulsifiers and this mode of soil removal is minimized versus conventional emulsification mechanisms. Subsequent examples show that emulsification surfactants tend to impart a negative effect on soil removal according to the invention.

The data also demonstrates that soil modification for the tested soil is improved using a weight ratio of the <2-mole ethoxylate nonionic-to-alkyl alkylate component (wt:wt) of between 4:0 and 0:4, with a preferred ratio of between 3:1 and 1:3, and a most preferred ratio of about 1:1.

This example demonstrates the effectiveness of the soil removal composition of the invention for removing caked on soil. It is believed that the effectiveness of the soil removal composition will be observed for caked on soil present on hard surfaces as well as textiles.

TABLE 1

Soil Modification: Ethoxylated Nonionic And Fatty Esters

| 1 Composition | 2 Actives[1] (wt ratio) 1-mole EO:methyl soyate | 3 Soil Modification Penetration Rate Relative to the Standard[2] (% Improvement) | 4 Soil Emulsification Empirical Detersive Capacity[3] |
|---|---|---|---|
| Prior Art | | | |
| 1 Standard (ILF-15 detergent)[4] | 0:0 | 0% (standard) | stable emulsion (>30 minutes) |
| 2 NPE-9.5[4] | 0:0 | −165% | stable emulsion (>15 minutes) |
| 3 NPE-4.5 + methyl soyate[5] | 0:0 | −59% | stable emulsion (>10 minutes) |
| 4 nonionic 4.5-ethoxylate | 0:0 | −1841% | stable emulsion (>5 minutes) |
| 5 Turbo Rev[6] | 0:0 | −18% | stable emulsion (>10 minutes) |
| Tests | | | |
| 6 Test Composition-1 | 100:0 | 29% | poor-emulsion (<10 seconds) |
| 7 Test Composition-2 | 75:25 | 35% | poor-emulsion (<10 seconds) |
| 8 Test Composition-3 | 50:50 | 53% | poor-emulsion (<10 seconds) |
| 9 Test Composition-4 | 25:75 | 47% | poor-emulsion (<10 seconds) |
| 10 Test Composition-5 | 0:100 | −6% | poor-emulsion (<10 seconds) |

[1]Active weight ratios of a 1-mole ethoxylated alcohol and methyl soyate (on an active basis).
[2]A soil modifying composition made by mixing 0.5 wt % composition, 0.5 wt % sodium meta silicate/NTA, with the remainder as water. Then measuring a timed penetration rate into the solidified dirty motor oil (relative to the penetration of a standard using the ILF-15 commercial product.
[3]Emulsion stability based on mixing 0.5 wt % liquid dirty motor oil, 0.5 wt % composition, 0.5 wt % sodium meta silicate, with the remainder as water; mixing the system at room temperature and observing the mix stability time to break into discrete layers.
[4]ILF-15 ® is a commercial dirty motor oil cleaning product containing complex blends of ethoxylates of >2-EO units and hydrocarbon solvents; from Ecolab Inc., St. Paul, MN. This product includes about 64 wt-% mineral spirits, 24 wt-% nonylphenol (9.5 mole) ethoxylate, and 12 wt-% nonylphenol (12 mole) ethoxylate.
[5]NPE-4.5 is nonylphenol ethoxylate with an average of 4.5 ethoxylate units.
[6]Turbo Rev ® is a commercial dirty motor oil detergent containing complex blends of ethoxylates of >2-EO units; from Ecolab Inc., St. Paul, IN.

EXAMPLE 2

This example demonstrates the effect of adding conventional emulsifying surfactants on the soil modification properties of the composition. See Falbaum et al., U.S. Pat. No. 5,741,768 and U.S. Pat. No. 5,750,484. The soil penetration tests repeated according to the procedure described in Example 1. The data reported in Table 2 illustrates the importance of keeping conventional detersive surfactants out of the soil modification step of the invention for one-step or two-step cleaning programs. Thus, in comparing the results of experiment 1 with experiments 2–4 in Table 2, the negative effect on soil penetration is demonstrated for certain surfactant detersive agents.

TABLE 2

Soil Modification: The Effect Of An Emulsifying Surfactant

| | 1 Actives[1] (wt ratio's) 1-EO nonionic: methyl soyate: Amphoteric[2] | 2 Soil Modification Penetration Rate Relative to the Standard[3] (% Improvement) | 3 Soil Emulsification Empirical Detersive Capacity[4] |
|---|---|---|---|
| 1 | 75:25:0 | 47%[2] | poor emulsion (<10 seconds) |
| 2 | 75:25:5 | −66% | stable emulsion (>10 minutes) |
| 3 | 75:25:10 | −65% | stable emulsion (>30 minutes) |
| 4 | 75:25:20 | −76% | stable emulsion (>30 minutes) |

[1]Active weight ratios of a 1-mole ethoxylated (EO) alcohol, methyl soyate, and Miranol CEM-38 amphoteric (on an active basis).
[2]An emulsifying surfactant additive for dirty motor oil soils as disclosed in U.S. Pat. No. 5,741,768 and U.S. Pat. No. 5,750,484.
[3]A soil modifying composition made by mixing 0.5 wt % composition, 0.5 wt % sodium meta silicate, with the remainder as water. Then measuring a timed penetration rate into the solidified dirty motor oil (relative to the penetration standard using the ILF-15 ® commercial product as in Table 1).
[4]Emulsion stability based on mixing 0.5 wt % liquid dirty motor oil, 0.5 wt % composition, 0.5 wt % sodium meta silicate, with the remainder as water; mixing the system at room temperature and observing the mix stability.

EXAMPLE 3

As in Example 2, where a conventional detersive surfactant was added, the effects adding a commercial blended detergent (surfactants and builders) are shown in Table 3. An industrial dirty motor oil cleaning product—Turbo Rev® from Ecolab Inc., St. Paul, Minn.—was added at various levels and the effects were noted for soil penetration rates. The results demonstrate the negative impact on penetration.

TABLE 3

Soil Modification: The Effect Of An Emulsifying Detergent Blend

| | 1 Actives[1] (wt ratio's) 1-mole EO: methyl soyate: Turbo Rev[2] | 2 Soil Modification Penetration Rate Relative to the Standard[3] (% Improvement) | 3 Soil Emulsification Empirical Detersive Capacity[1] |
|---|---|---|---|
| 1 | 50:50:0 | 53% | poor emulsion (<10 seconds stability) |
| 2 | 33:33:34 | 21% | stable emulsion (>15 minutes) |
| 3 | 25:25:50 | 24% | stable emulsion (>30 minutes) |
| 4 | 13:13:74 | 24% | very stable emulsion (>45 minutes) |
| 5 | 0:0:100 | −15% | very stable emulsion (>60 minutes) |

TABLE 3-continued

Soil Modification: The Effect Of An Emulsifying Detergent Blend

| | 1 Actives[1] (wt ratio's) 1-mole EO: methyl soyate: Turbo Rev[2] | 2 Soil Modification Penetration Rate Relative to the Standard[3] (% Improvement) | 3 Soil Emulsification Empirical Detersive Capacity[1] |
|---|---|---|---|
| 6 | 50:25:25 | 23% | stable emulsion (>30 minutes |
| 7 | 75:0:25 | −23% | very stable emulsion (>60 minutes) |

[1]Active weight ratios of a 1-mole ethoxylated alcohol to methyl soyate to Turbo Rev ®.
[2]Turbo Rev ® is a commercial dirty motor oil detergent containing complex blends of ethoxylates of >2-EO units; from Ecolab Inc., St. Paul, MN.
[3]A soil modifying composition made by mixing 0.5 wt % composition, 0.5 wt % sodium meta silicate, with the remainder as water. Then measuring a timed penetration rate into the solidified dirty motor oil (relative to the penetration standard using the ILF-15 ® commercial product as in Table 1).

EXAMPLE 4

Table 4 illustrates the results of using the soil removal composition of the invention in an industrial parts cleaning program. As shown, the soil removal composition of the invention is shown to work at least as effectively as the prior art, but without the use of deleterious high VOC mineral spirits. Both yielded excellent ratings in soil removal; however, the soil removal composition of the invention including 1-EO nonionic/methyl soyate formula exhibited no offensive odor or mineral spirit off-gassing. Also, the effect of adding conventional emulsifiers to the composition is shown by comparing experiments 2 with experiments 3 and 4. As shown previously, the strong negative effect noted for the soil modification rates is duplicated in the industrial cleaning process.

TABLE 4

Industrial Dirty Parts Cleaning From hard Surfaces

| | 1 Actives[2] (wt ratio's) 1-mole EO: methyl soyate | 2 Detergent Additive (wt ratio's) Turbo Rev[3] | 3 Industrial Parts Cleaning (Soil Removal)[4] Relative Visual Test[5] |
|---|---|---|---|
| 1 | ILF-15 detergent (control)[1] | 0% | Excellent (<20 seconds cleaning time) |
| 2 | 75:25 | 0% | Excellent (<20 seconds cleaning time) |
| 3 | 75:25 | 8% | Poor (>40 seconds cleaning time) |
| 4 | 50:50 | 8% | Fair (>30 seconds cleaning time) |

[1]Emulsion stability based on mixing 0.5 wt % liquid dirty motor oil, 0.5 wt % composition, 0.5 wt % sodium meta silicate, with the remainder as water; mixing the system at room temperature and observing the mix stability.
[2]Active weight ratios of a 1-mole ethoxylated alcohol and methyl soyate except the ILF-15 ® prior art which is a commercial dirty motor oil cleaning product containing complex blends of ethoxylates of >2-EO units and hydrocarbon solvents; from Ecolab Inc., St. Paul, MN.
[3]Turbo Rev ® is a commercial dirty motor oil detergent containing complex blends of ethoxylates of >2-EO units; from Ecolab Inc., St. Paul, MN.

TABLE 4-continued

Industrial Dirty Parts Cleaning From hard Surfaces

| 1 Actives[2] (wt ratio's) 1-mole EO: methyl soyate | 2 Detergent Additive (wt ratio's) Turbo Rev[3] | 3 Industrial Parts Cleaning (Soil Removal)[4] Relative Visual Test[5] |
|---|---|---|

[4]Soil removal and parts cleaning determined by mixing 0.5 wt % composition, 0.5 wt % sodium meta silicate, with the remainder as water in a 30 gallon industrial parts washer. Then subjecting a series of dirty test panels cut from a used oil pan, followed by visual evaluation after a set number of mechanical scrubs over a constant test time.
[5]Visual ratings based on cleanliness after 5 brush strokes over a 15 second wash time. Excellent = >90% clean, Fair = >70% clean, Poor = <60% soil removal in the wash time. The cleaning times are to reach >70% cleaning.

EXAMPLE 5

A test was conducted in which soil removal compositions of the invention were used as pre-treatment compositions and compared with conventional solvent based pre-treatment compositions using identical laundry detergents and equipment. The use of the soil removal compositions of the invention was compared to the use of conventional laundry detergents and equipment without a pre-treatment composition. The soil removal composition of the invention includes 40 wt-% alcohol ethoxylate wherein the alkyl group has between about 12 and about 14 carbon atoms and the degree polymerization is about 1; 40 wt-% methyl soyate; and 20 wt-% 2-butoxy ethanol. This composition is referred to as composition A in Table 5. The laundry detergent used had a formulation disclosed in Falbaum et al., U.S. Pat. Nos. 5,523,000; 5,741,768 and 5,750,484. The pretreatment took place for about 5 minutes, and the wash step took place for about 15 minutes. The pre-treatment composition was allowed to drain prior to the wash step in experiments three and four. The results are presented in Table 5.

TABLE 5

| | PRE-TREATMENT | WASH STEP | APPEARANCE |
|---|---|---|---|
| 1 | None | Conventional Laundry Detergent and Phosphate Builder | Still Heavily Soiled |
| 2 | None | Conventional Laundry Detergent and Phosphate Builder combined with Composition A | Black Blotches Remaining |
| 3 | Mineral spirits 64%, nonylphenol (9.5 mole) ethoxylate 24%, nonylphenol (12 mole) thoxylate 12% | Conventional Laundry Detergent and Phosphate Builder | Black Blotches Remaining |
| 4 | Composition A | Conventional Laundry Detergent and Phosphate Builder | Clean; With no Blotches |

The results of the test illustrate the benefit of the new pre-treatment compositions in a pretreatment step over solvent based technology. The data shows the ability of pre-treatment with the composition of the invention followed by a conventional laundry detergent to remove soils whereas the absence of the pre-treatment or the use of a solvent based pre-treatment did not remove soil satisfactorily. The data additionally shows the importance of separating the pretreatment step using the composition of the invention from the wash step using a conventional laundry detergent. As demonstrated by experiment 2 in Table 5, combining the soil removal composition with a conventional laundry detergent results in incomplete cleaning.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for removing hydrophobic and particulate soil from an article, the process comprising a step of:

(a) contacting a soiled article with a hydrophobic and particulate soil removal composition comprising:

(i) an effective treating amount of an ethoxylate mixture containing ethoxylate groups and having the formula:

$$R_1—(OC_2H_4)_m—OH$$

wherein $R_1$ contains about 6 to about 26 carbon atoms and m is an average value of 2 or less;

(ii) an effective treating amount of a fatty acid ester component having the formula:

$$R_3—CO_2—R_4$$

wherein $R_3$ is an alkyl group having about 6 to about 24 carbon atoms and $R_4$ is an alkyl group having about 1 to about 6 carbon atoms, wherein the composition is free of hydrocarbons; and (iii) processing aid to provide the hydrophobic and particulate soil removal composition with freeze stability;

wherein the soiled article comprises an article soiled by at least one of motor oils, asphaltenes, hydrocarbon tars, coal tars, petroleum greases, transmission fluids, hydraulic oils, and hydraulic greases; and (b) rinsing the hydrophobic and particulate soil removal composition from the article.

2. A method according to claim 1, wherein the processing aid is selected from at least one of glycol ethers, glycols, carbitols, and mixtures thereof.

3. A method according to claim 1, wherein the article comprises a hard surface selected from at least one of metals, glass, plastics, rubbers, and ceramics.

4. A method according to claim 1, wherein the article comprises a fabric containing at least one of cotton fibers, polyester fibers, polyamide fibers, acrylic fibers, acetate fibers, and mixtures thereof.

5. A method according to claim 1, wherein the step of contacting comprises contacting at about 20° C. to about 60° C.

6. A method according to claim 1, wherein the step of contacting comprises contacting for about 10 seconds to about 600 seconds.

7. A method according to claim 1, wherein the composition comprises a weight ratio of surfactant to fatty acid ester of between about 1:4 and about 4:1.

8. A method according to claim 1, wherein the composition comprises a weight ratio of surfactant to fatty acid ester of between about 3:1 and about 1:1.

9. A method according to claim 1, wherein $R_1$ comprises an unsaturated aliphatic group.

10. A method according to claim 1, wherein $R_3$ is a methyl group.

11. A method according to claim 1, wherein the soil comprises used motor oil.

12. A method according to claim 1, the soil comprises used motor oil and particulate carbon.

13. A method according to claim 1, wherein the composition is free of a solvent liquid.

14. A method according to claim 1, wherein the article comprises at least one of a polyester fabric, a cotton fabric, and a polyester and cotton blend fabric.

15. A method according to claim 14, further comprising a step of laundering with an aqueous laundry detergent.

16. A method according to claim 15, wherein the step of contacting takes place in a pre-treatment step and the composition is allowed to drain prior to the step of laundering.

17. A method according to claim 1, wherein the treatment composition comprises about 50 to about 100 wt.-% of combined ethoxylate and fatty acid ester.

18. A method according to claim 1, wherein the article comprises a motor vehicle part.

19. A method according to claim 1, wherein the fatty acid ester component comprises a fatty acid ester of at least one of soy, castor, oleic, linoleic, linolenic, ricinoleic, stearic, caprylic, coconut, myristic, and wood acid abietic.

20. A method according to claim 1, wherein the fatty acid ester component comprises at least one of methyl soyate, ethyl soyate, propyl soyate, methyl abietate, and propyl linoleate.

21. A method according to claim 1, wherein the processing aid comprises at least one of tripropylene glycol monomethyl ether, dipropylene glycol monomethyl ether, monopropylene glycol monomethyl ether, ethyl carbitol, propyl carbitol, and phenyl carbitol.

22. A method according to caim 1, wherein the hydrophobic and particulate soil removal composition contains no anionic surfactant.

23. A method according to claim 11, wherein the laundry item comprises at least one of cotton fibers, polyester fibers, polyamide fibers, acrylic fibers, acetate fibers, and blends thereof.

24. A method for removing hydrophobic and particulate soil from laundry items, the process comprising steps of:

(a) contacting a soiled laundry item with a pre-treatment composition comprising:

(i) an effective treating amount of ethoxylate mixture containing ethoxylate groups and having the formula:

$$R_1—(OC_2H_4)_m—OH$$

wherein $R_1$ contains about 6 to about 26 carbon atoms and m is an average value of 2 or less; and (ii) an effective treating amount of a fatty acid ester component having the formula:

$$R_3—CO_2—R_4$$

wherein $R_3$ is an alkyl group having about 6 to about 26 carbon atoms and $R_4$ is an alkyl group having about 1 to about 6 carbon atoms;

(iii) wherein the hydrophobic and particulate soil removal composition comprises a weight ratio of ethoxylate component to fatty acid ester component of between about 1:4 and about 4:1;

wherein the soiled article comprises an article. soiled by at least one of motor oils, asphaltenes, hydrocarbon tars, coal tars, petroleum greases, transmission fluids, hydraulic oils, and hydraulic greases; and (iv) an effective amount of a processing aid to provide freeze stability; and (b) laundering the treated laundry item with an aqueous laundry detergent.

25. A method according to claim 24, wherein the step of contacting a soiled laundry item with a pre-treatment composition comprises treating at a temperature of between about 20° C. and about 60° C. for a time period of between about 10 seconds and about 600 seconds.

26. A method according to claim 24, wherein the step of laundering is preceded by a step of rinsing the pre-treatment composition from the laundry item.

27. A method according to claim 24, wherein the composition comprises a weight ratio of surfactant to fatty acid ester of between about 1:4 and about 4:1.

28. A method according to claim 24, wherein the composition comprises a weight ratio of surfactant to fatty acid ester of between about 3:1 and about 1:1.

29. A method according to claim 24, wherein $R_1$ comprises an unsaturated aliphatic group.

30. A method according to claim 24, wherein $R_3$ is a methyl group.

31. A method according to claim 24, wherein the soil comprises used motor oil.

32. A method according to claim 24, the soil comprises used motor oil and particulate carbon.

33. A method according to claim 24, wherein the composition is free of a solvent liquid.

34. A method according to claim 24, wherein the article comprises at least one of a polyester fabric, a cotton fabric, and a polyester and cotton blend fabric.

35. A method according to claim 24, wherein the fatty acid ester component comprises a fatty acid ester of at least one of soy, castor, oleic, linoleic, linolenic, ricinoleic, stearic, caprylic, coconut, myristic, and wood acid abietic.

36. A method according to claim 24, wherein the fatty acid ester component comprises at least one of methyl soyate, ethyl soyate, propyl soyate, methyl abietate, and propyl linoleate.

37. A method according to claim 24, wherein the processing aid comprises at least one of tripropylene glycol monomethyl ether, dipropylene glycol monomethyl ether, monopropylene glycol monomethyl ether, ethyl carbitol, propyl carbitol, and phenyl carbitol.

38. A method according to claim 24, wherein the soiled article comprises an article soiled by at least one of motor oils, asphaltenes, hydrocarbon tars, coal tars, petroleum greases, transmission fluids, hydraulic oils, and hydraulic greases.

39. A method according to claim 24, wherein the hydrophobic and particulate soil removal composition contains no anionic surfactant.

40. A method for removing hydrophobic and particulate soil from skin, the process comprising a step of:

(a) contacting hydrophobic and particulate soil provided on skin with a hydrophobic and particulate soil removal composition to remove the hydrophobic and particulate soil provided on skin, the hydrophobic and particulate soil removal composition comprising:

(i) an effective treating amount of an ethoxylate mixture containing ethoxylate groups and having the formula:

$$R_1—(OC_2H_4)_m—OH$$

wherein $R_1$ contains about 6 to about 24 carbon atoms and m is an average value of 2 or less;

(ii) an effective treating amount of a fatty acid ester component having the formula:

$$R_3—CO_2—R_4$$

wherein $R_3$ is an alkyl group having about 6 to about 24 carbon atoms and $R_4$ is an alkyl group having about 1 to about 6 carbon atoms; and (b) rinsing the hydrophobic and particulate soil removal composition and the hydrophobic and particulate soil from the skin.

41. A method according to claim 40, wherein the hydrophobic and particulate soil comprises a hydrophobic component and a particulate component, wherein the hydrophobic component comprises at least one of hydrocarbon, tar, bitumen, and asphalt, and the particulate component comprises at least one of mineral clay, sand, dirt, clay, natural mineral matter, carbon black, graphite, graphitic material, and caolin.

42. A method according to claim 40, wherein the hydrophobic and particulate soil removal composition contains between about 10 wt. % and about 30 wt. % of a processing aid to provide freeze stability.

43. A method for removing hydrophobic and particulate soil from an article, the process comprising a step of:

(a) contacting a soiled article with a hydrophobic and particulate soil removal composition comprising:

(i) an effective treating amount of an ethoxylate mixture containing ethoxylate groups and having the formula:

$$R_1—(OC_2H_4)_m—OH$$

wherein $R_1$ contains about 6 to about 26 carbon atoms and m is an average value of 2 or less;

(ii) an effective treating amount of a fatty acid ester component having the formula:

$$R_3—CO_2—R_4$$

wherein $R_3$ is an alkyl group having about 6 to about 24 carbon atoms and $R_4$ is an alkyl group having about 1 to about 6 carbon atoms, wherein the composition is free of hydrocarbons;

wherein the soiled article comprises an article soiled by at least one of motor oils, asphaltenes, hydrocarbon tars, coal tars, petroleum greases, transmission fluids, hydraulic oils, and hydraulic greases; and (iii) processing aid to provide the hydrophobic and particulate soil removal composition with freeze stability; wherein the article comprises a motor vehicle part; and (b) rinsing the hydrophobic and particulate soil removal composition from the article.

44. A method for removing hydrophobic and particulate soil from an article, the process comprising a step of:

(a) contacting a soiled article with a hydrophobic and particulate soil removal composition comprising:

(i) an effective treating amount of an ethoxylate mixture containing ethoxylate groups and having the formula:

$$R_1—(OC_2H_4)_m—OH$$

wherein $R_1$ contains about 6 to about 26 carbon atoms and m is an average value of 2 or less;

(ii) an effective treating amount of a fatty acid ester component having the formula:

$$R_3—CO_2—R_4$$

wherein $R_3$ is an alkyl group having about 6 to about 24 carbon atoms and $R_4$ is an alkyl group having about 1 to about 6 carbon atoms, wherein the composition is free of hydrocarbons; and (iii) processing aid to provide the hydrophobic and particulate soil removal composition with freeze stability, wherein the processing aid comprises at least one of tripropylene glycol monomethyl ether, dipropylene glycol monomethyl ether, monopropylene glycol monomethyl ether, ethyl carbitol, propyl carbitol, and phenyl carbitol;

(b) rinsing the hydrophobic and particulate soil removal composition from the article.

45. A method for removing hydrophobic and particulate soil from laundry items, the process comprising steps of:

(a) contacting a soiled laundry item with a pre-treatment composition comprising:

(i) an effective treating amount of ethoxylate mixture containing ethoxylate groups and having the formula:

$$R_1—(OC_2H_4)_m—OH$$

wherein $R_1$ contains about 6 to about 26 carbon atoms and m is an average value of 2 or less; and (ii) an effective treating amount of a fatty acid ester component having the formula:

$$R_3—CO_2—R_4$$

wherein $R_3$ is an alkyl group having about 6 to about 26 carbon atoms and $R_4$ is an alkyl group having about 1 to about 6 carbon atoms;

(iii) wherein the hydrophobic and particulate soil removal composition comprises a weight ratio of ethoxylate component to fatty acid ester component of between about 1:4 and about 4:1;

wherein the soiled article comprises an article soiled by at least one of motor oils, asphaltenes, hydrocarbon tars, coal tars, petroleum greases, transmission fluids, hydraulic oils, and hydraulic greases; and (iv) an effective amount of a processing aid to provide freeze stability, wherein the processing aid comprises at least one of tripropylene glycol monomethyl ether, dipropylene glycol monomethyl ether, monopropylene glycol monomethyl ether, ethyl carbitol, propyl carbitol, and phenyl carbitol; and (b) laundering the treated laundry item with an aqueous laundry detergent.

* * * * *

UNITED STATES PATENT AND TRADEMARK OFFICE

CERTIFICATE OF CORRECTION

PATENT NO. : 6,440,910 B1
DATED : August 27, 2002
INVENTOR(S) : Smith et al.

It is certified that error appears in the above-identified patent and that said Letters Patent is hereby corrected as shown below:

Title page,
Item [75], Inventors, "Kim R. Smith, Woodbury; Robert D. P. Hei, Baldwin; Carrie Armstrong, Mahtomedi; Paul Mattia, Prior Lake; Wendy Wiseth, St. Paul, Jennifer Layton, White Bear Lake, Mark Levitt, St. Paul, all of MN (US)" should read -- Kim R. Smith, Woodbury, MN; Robert D. P. Hei, Baldwin, WI; Carrie Armstrong, Mahtomedi, MN; Paul Mattia, Prior Lake, MN; Wendy Wiseth, St. Paul, MN, Jennifer Layton, White Bear Lake, MN, Mark Levitt, St. Paul, MN (all of US) --

Column 1,
Line 18, "renoval" should read -- removal --

Column 7,
Line 6, "dispemsing" should read -- dispensing --

Column 9,
Line 48, "Aernatively" should read -- Alternatively --

Column 10,
Line 26, "further her" should read -- further --

Column 16,
Line 61, "article . soiled" should read -- article soiled --

Signed and Sealed this

Sixth Day of May, 2003

JAMES E. ROGAN
*Director of the United States Patent and Trademark Office*